US005747707A

United States Patent [19]

Johansson et al.

[11] Patent Number: 5,747,707

[45] Date of Patent: May 5, 1998

[54] MEASURING DEVICE FOR REFINERS

[75] Inventors: Ola Johansson, Timrå; Olof Kjellqvist, Sundsvall, both of Sweden

[73] Assignee: Sunds Defibrator Industries AB, Sweden

[21] Appl. No.: 698,810

[22] Filed: Aug. 16, 1996

[30] Foreign Application Priority Data

Aug. 21, 1995 [SE] Sweden ..... 9502892

[51] Int. Cl.[6] ..... G01L 1/04

[52] U.S. Cl. ..... 73/862.623; 73/862.541; 241/261.3

[58] Field of Search ..... 73/862.541, 862.623, 73/862.632, 862.635, 53.03; 241/261.2, 261.3, 296, 297

[56] References Cited

U.S. PATENT DOCUMENTS

| | | | |
|---|---|---|---|
| 2,848,892 | 8/1958 | Hoffman | 73/862.629 |
| 3,411,348 | 11/1968 | Schuktheis, Jr. | 73/862.629 |
| 3,826,130 | 7/1974 | Pusch | 73/862.629 |
| 3,871,216 | 3/1975 | Eder | 73/862.633 |
| 4,114,818 | 9/1978 | Paakkinen et al. | 241/244 |
| 4,148,439 | 4/1979 | Floden . | |
| 4,570,862 | 2/1986 | Kirchner | 241/28 |
| 4,676,440 | 6/1987 | Perkola | 241/261.3 |
| 4,712,745 | 12/1987 | Leith | 241/261.3 |
| 4,772,358 | 9/1988 | Virving | 241/297 X |
| 4,886,576 | 12/1989 | Sloan | 73/53.03 X |
| 5,362,003 | 11/1994 | Virving | 241/261.3 |
| 5,373,995 | 12/1994 | Johansson | 241/261.3 X |
| 5,472,285 | 12/1995 | Kjellqvist | 384/556 |

*Primary Examiner*—Elizabeth L. Dougherty
*Attorney, Agent, or Firm*—Lerner, David, Littenberg, Krumholz & Mentlik

[57] ABSTRACT

Refining apparatus is disclosed including a pair of relatively rotatable refining disks including radial refining bars extending along at least part of the refining gap between those disks, and at least one of the refining bars comprising a sensor bar including strain gauges for sensing the load exerted thereon during refining at a number of points along the sensor bar.

7 Claims, 1 Drawing Sheet

MEASURING DEVICE FOR REFINERS

FIELD OF THE INVENTION

The present invention relates to a measuring device for refiners having refining disks that define between them refining gaps for refining material on bars arranged between the disks, the bars extending across the refining zones of the refining disks.

BACKGROUND OF THE INVENTION

In connection with the known use of relatively rotatable refining disks, the energy applied is measured in the main motor. Thus, only the total energy applied is measured. The object of the present invention is to instead measure the actual energy applied to the material to be refined, as a function of the radius of the refining disk. Using this information as a basis, the refiner can then be controlled for optimal pulp quality and minimal energy consumption. If the energy applied to the inlet zone of the refiner is too high, for instance, fiber damage may occur, and the outer refining zone will not operate under optimal conditions. Similarly, if insufficient energy is supplied to the inlet zone, the other zones will be unable to deal with the through-flow required. The operating parameters that can be varied are gap breadth, viscosity of the material to be refined, pressure difference and through-flow, to mention but a few.

The present invention has a particular application area in refiners having several independent refining gaps. In a refiner consisting of a rotor having refiner segments on both sides, and two stators, one for each side of the rotor, only the total load is obtained since the rotor is common to both refining zones. Similarly, the conically shaped peripheral zone in a conical refiner can be adjusted independently of the inner, flat zone. Hitherto it has not been practically possible to discover how much energy is applied to one zone as compared with another. Thanks to the present invention, however, refiners having one or more refining zones can be controlled more accurately since it is then known where the load has been applied.

Admittedly it is known through Swedish Patent No. B 7 601,019-8 to measure e.g. temperature or pressure on the material in the refining gap by placing sensors in that area. However, the load between bars and material is still not accessible.

SUMMARY OF THE INVENTION

In accordance with the present invention, these and other objects have now been realized by the invention of refining apparatus comprising first and second relatively rotatable refining disks defining a refining gap therebetween, the refining disks including a plurality of radial refining bars extending along at least part of the refining gap, and at least one of the plurality of refining bars comprising a sensor bar including sensing means for sensing the load exerted thereon during the refining at a plurality of points along the sensor bar.

In accordance with a preferred embodiment of the refining apparatus of the present invention, the sensing means comprises a plurality of strain gauges located at the plurality of points along the sensor bar whereby the stresses exerted on the sensor bar can be determined from the deformation of the sensor bar at the plurality of points. Preferably, the apparatus includes a plurality of these strain gauges located at at least one of the plurality of points, whereby the stresses exerted at the at least one of the plurality of points can be divided into load components acting in separate directions. In a preferred embodiment, the plurality of strain gauges are located at each of the plurality of points.

In accordance with one embodiment of the refining apparatus of the present invention, the apparatus includes a plurality of temperature gauges located proximate to each of the plurality of points along the sensor bar whereby the stresses can be compensated for thermal expansion. In a preferred embodiment, the plurality of temperature gauges includes steam pressure and velocity measurement means for measuring the pressure and velocity of steam supplied to the refining gap.

In accordance with another embodiment of the refining apparatus of the present invention, the apparatus includes control means for controlling the refining in response to the load determined by the sensing means.

BRIEF DESCRIPTION OF THE DRAWINGS

The present invention will now be described in more detail with reference to the accompanying drawings in which.

DETAILED DESCRIPTION

Figure 1:
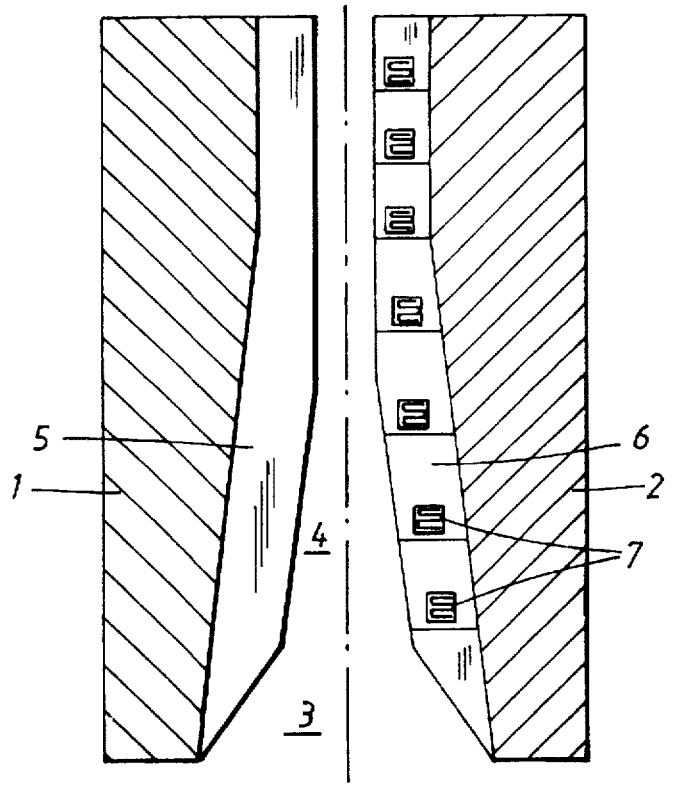
FIG. 1 is a side, elevational, radial cross-sectional view of the inner part of two refining disks in a refiner in accordance with the present invention.

Referring to the Figures, in which like reference numerals refer to the elements thereof, FIG. 1 shows a typical refining zone. The two refining disks 1 and 2 move with a predetermined constant speed of rotation in relation to each other. The material to be refined is fed into the refining gap at the center of the refining disks, in FIG. 1 from below, and thus enters the refining zone 4. In refining zone 4, the bars 5 and 6 in the refining machinery will be subjected to a load from the material. This load is dependent on the properties of the material, the breadth of the refining gap, the through-flow, temperature, moisture content and geometry of the machinery. The energy level applied is dependent on many variables. It is well known, for instance, that at temperatures above the glass transition temperature, the energy required to break down the wood into smaller particles is much less than at temperatures somewhat below the glass transition temperature. The significance of the moisture content for the energy applied is also well known, although its mechanism is not quite clear. In general, refining pulp with a lower moisture content (high viscosity) gives higher specific energy. Similarly, the refining gaps and through-flow levels greatly influence the specific energy applied.

The parameters mentioned above, with the exception of the geometry of the machinery, an be used to control the load applied, thus producing a control system with feedback.

Figure 2:
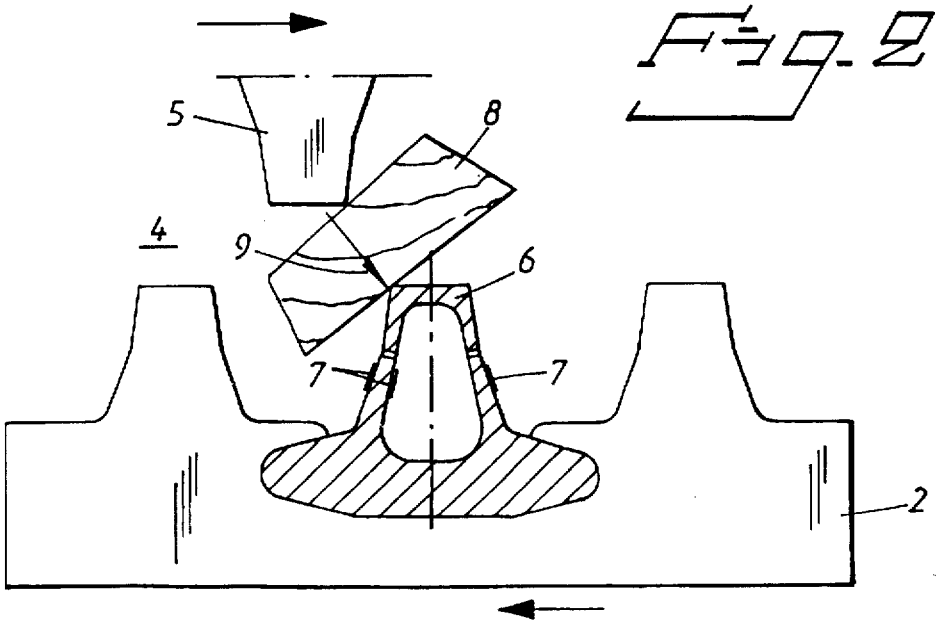
FIG. 2 is a partial, front, elevational view taken perpendicular to the bars of the refining disks shown in FIG. 1, with one sensor bar in cross section.

To this end at least one of the bars has, according to the present invention, been made in the form of a sensor bar 6. This sensor bar is provided along its length with strain gauges 7 distributed over a number of measuring points along the bar 6. FIG. 2 shows three strain gauges 7 at one measuring point. Measuring the strain at two or more points on the surface of the sensor bar enables determination of the deformation.

FIG. 2 shows a piece of wood 8 as the material to be refined, being subjected to mechanical processing between the bars 5 and 6. This operation may take several forms. The piece of wood may, for instance, be compressed, crushed or fibrillated in the refining zone. In the figure, the piece of wood 8 is crushed between the bar 5 and the sensor bar 6 when the bars move in relation to each other as indicated by the horizontal arrows. When the sensor bar 6 is loaded as indicated by the arrow 9 it will be slightly deformed. This deformation will be measured by the strain gauges 7, which are located such that the strain can be divided into load components acting in separate directions.

The stresses to which the sensor bar 6 is subjected can then be related to the strain with the aid of linear equations, provided that the liquid limit of the material has not been reached. This conversion is performed in a control device, where a computer program calculates the load applied as a function of the strain measured. The solution can be obtained analytically or numerically depending on the geometry of the sensor bar. The energy applied as a function of the radius of the refining disk is stated in kilowatt per millimeter, for instance.

Suitably, the temperature is also measured at each measuring point, in order to enable compensation of the strain measurement for thermal expansion. The temperature gauges can also be used to determine the pressure and velocity of steam supplied, as a function of the radius of the refining disk.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

We claim:

1. Refining apparatus comprising first and second relatively rotatable refining disks defining a refining gap therebetween, said refining disks including a plurality of radial refining bars extending along at least part of said refining gap, and at least one of said plurality of refining bars comprising a sensor bar including sensing means for sensing a deformation of said sensor bar during said refining at a plurality of points along said sensor bar.

2. The refining apparatus of claim 1 wherein said sensing means comprises a plurality of strain gauges located at said plurality of points along said sensor bar whereby a load exerted on said sensor bar can be determined from said deformation of said sensor bar at said plurality of points.

3. The refining apparatus of claim 2 including a plurality of said strain gauges located at at least one of said plurality of points, whereby said stresses exerted at said at least one of said plurality of points can be divided into load components acting in separate directions.

4. The refining apparatus of claim 3 wherein said plurality of strain gauges are located at each of said plurality of points.

5. The refining apparatus of claim 1 including a plurality of temperature gauges located proximate to each of said plurality of points along said sensor bar whereby said stresses can be compensated for thermal expansion.

6. The refining apparatus of claim 5 wherein said plurality of temperature gauges includes steam pressure and velocity measurement means for measuring the pressure and velocity of steam supplied to said refining gap.

7. The refining apparatus of claim 1 including control means for controlling said refining in response to said load determined by said sensing means.

* * * * *